US005898403A

United States Patent [19]

Saitoh et al.

[11] Patent Number: 5,898,403

[45] Date of Patent: Apr. 27, 1999

[54] ANTENNA FORMED OF MULTIPLE DIELECTRIC SUBSTRATES INCLUDING SHIELDED LC FILTER

[75] Inventors: Yasuaki Saitoh; Kazunari Kawahata, both of Kyoto, Japan

[73] Assignee: Murata Manufacturing Co., Ltd., Kyoto, Japan

[21] Appl. No.: 08/427,415

[22] Filed: Apr. 24, 1995

[30] Foreign Application Priority Data

May 20, 1994 [JP] Japan ..... 6-106764

[51] Int. Cl.[6] ..... H01Q 1/38

[52] U.S. Cl. ..... 343/700 MS; 343/850

[58] Field of Search ..... 333/204; 343/700 MS, 343/853, 850, 702; H01Q 23/00, 1/38

[56] References Cited

U.S. PATENT DOCUMENTS 5,043,738 8/1991 Shapiro et al. ..... 343/700 MS 5,438,697 8/1995 Fowler et al. ..... 343/700 MS 5,483,678 1/1996 Abe ..... 343/702

*Primary Examiner*—Michael C. Wimer

*Attorney, Agent, or Firm*—Keiichi Nishimura

[57] ABSTRACT

An antenna device has an antenna part and a filter part combined into a single unit. The antenna part has a radiating electrode formed on a surface of layered dielectric substrates and a grounding electrode formed inside the layered structure. The filter part is formed below the antenna part and includes shield electrodes, capacitor electrodes and coil electrodes. A feed point on the antenna part and an input section of the filter part are electrically connected to each other through a roughhole, and external electrodes are formed on side surfaces of the multi-layered structure of the dielectric substrates, connecting the grounding electrode of the antenna part and the output section of the filter part. A slot electrode having a slot formed therethrough and a strip line extending perpendicularly to the slot may be inserted between the radiating electrode and the grounding electrode of the antenna part.

9 Claims, 4 Drawing Sheets

ANTENNA FORMED OF MULTIPLE DIELECTRIC SUBSTRATES INCLUDING SHIELDED LC FILTER

BACKGROUND OF THE INVENTION

This invention relates to an antenna device which combines an antenna and a filter into a single unit.

As shown in FIG. 5, a prior art antenna device used for a system such as the GPS (Global Positioning System) installed on an automobile is composed of an antenna, a filter, a preamplifier and a receiver. Signals received by the antenna are sent to the filter, by which a desired frequency is selected, and are transmitted to the receiver through the preamplifier. As shown in FIG. 6, such a prior art antenna device 57 is formed by providing a printed circuit board 51 with electrode patterns 51*a* and 51*b* formed on its surfaces and mounting a microstrip-type antenna 55 on its upper surface and a filter 56 on its lower surface, the antenna 55 having a radiating electrode 53 formed on the upper surface of a dielectric substrate 52 and a grounding electrode 54 formed on the lower surface of the dielectric substrate 52. A feed line 58 is provided to connect a feed point 53*a* on the radiating electrode 53 of the antenna 55 to one end of the electrode pattern 51*a* on the lower surface of the printed circuit board 51, and the filter 56 is attached to the opposite end of the electrode pattern 51*a*. Thus, electromagnetic waves received by the radiating electrode 53 of the antenna 55 are transmitted to the filter 56 through the feed line 58 and the electrode pattern 51*a*. The grounding electrode 54 of the antenna 55 is connected to the ground through the other electrode pattern 51*b* on the printed circuit board 51.

For a prior art antenna device of this type, however, the antenna 55 and the filter 56 must be manufactured separately and mounted to the printed circuit board 51 separately. This means not only that both the cost of parts and that of the mounting are high but also that the antenna device 57, as a whole, becomes rather large. Since the antenna 55 and the filter 56 are connected through the electrode pattern 51*a*, furthermore, the impedance matching between the antenna 55 and the filter 56 becomes unstable. This has the adverse effect of increasing the reflection loss and the transmission loss of the signals.

SUMMARY OF THE INVENTION

It is therefore an object of this invention to eliminate these problems associated with prior art antenna devices by providing an improved antenna device, which is compact, has a small reflection loss and costs less, having its antenna and filter parts formed as a single unit within a layered structure of dielectric substrates.

An antenna device embodying this invention, with which the above and other objects can be accomplished, may be characterized as having an antenna part and a filter part combined into a single unit, the antenna part having a radiating electrode formed on a surface of layered dielectric substrates which contain therein a grounding electrode and the filter part being formed below the antenna part and including shield electrodes, capacitor electrodes and coil electrodes. A feed point on the antenna part and an input section of the filter part are electrically connected to each other through a throughhole, and external electrodes are formed on side surfaces of the multi-layered structure of the dielectric substrates, connecting the grounding electrode of the antenna part and the output section of the filter part. A slot electrode having a slot formed therethrough and a strip line extending perpendicularly to the slot may be inserted between the radiating electrode and the ground electrode of the antenna part.

An antenna device thus formed can be made compact because its antenna and filter parts are formed as a single combined unit inside a multi-layered structure of dielectric substrates. The production process can be simplified, and it can be surface-mounted to a printed circuit board by a single operation. Since the feed point of the antenna part and the input section of the filter part are connected by a shortest distance through an internal throughhole, instability in impedance matching can be eliminated and the reflection loss can be reduced.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
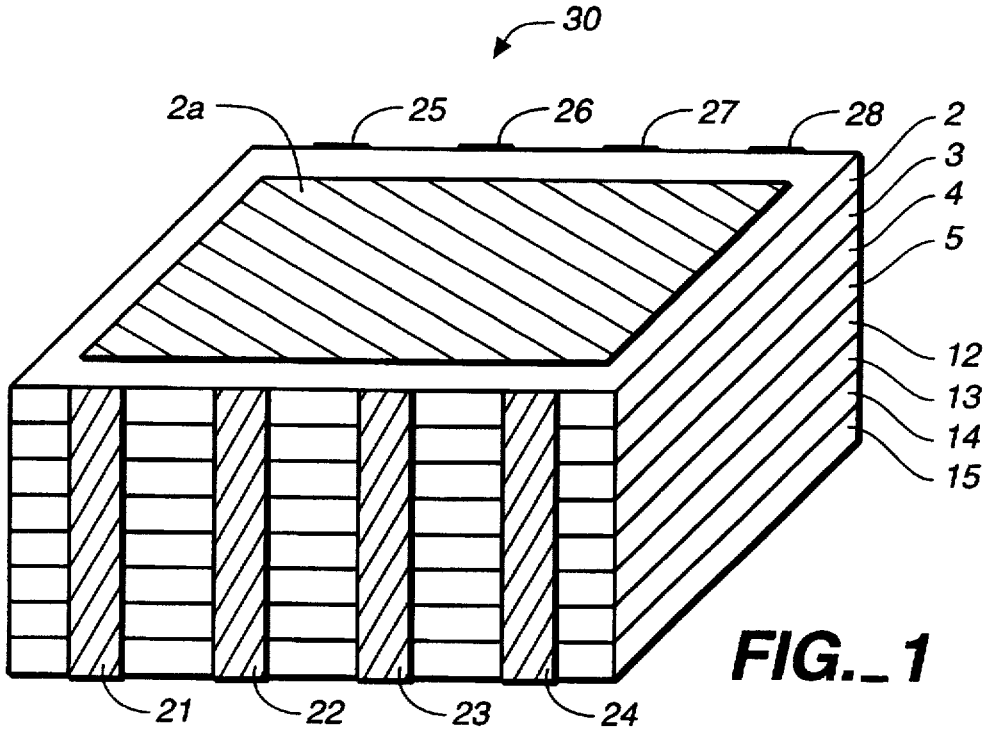
FIG. 1 is a perspective view of an antenna device according to a first embodiment of this invention.

As shown in FIG. 1, an antenna device 30 according to a first embodiment of this invention is composed of a microstrip-type antenna part 1 and a LC-type filter part 11 in a layered formation and having external electrodes 21–28 formed on side surfaces. The antenna part 1 is formed with first through fourth rectangular dielectric substrates 2–5 piled one on top of another in a layered structure, having radiating electrode 2*a* on the upper surface and grounding electrodes (not shown) inside. The LC-type filter part 11 is attached below the antenna part 1 and is formed with fifth through eighth similarly shaped dielectric substrates 12–15 piled one on top of another in another layered structure, having electrodes (not shown) for forming coils and capacitors. The external electrodes 21–28 are formed on side surfaces of the combination of the antenna and filter parts 1 and 11 thus formed.

Explained more in detail with reference to FIG. 2*f* the radiating electrode 2*a* is formed on the upper surface of the top dielectric substrate 2 of the antenna part 1, and a grounding electrode 5*a* with its corners connected to the external electrodes 22, 23, 25–28 is formed on the upper surface of the bottom dielectric substrate 5 of the antenna part 1. The intermediate dielectric substrates 3 and 4 are dummy layers for providing a proper Q-value for the antenna part 1. The number of these intermediate dielectric substrates inserted between the top and bottom substrates 2 and 5 may be appropriately varied for the purpose.

As for the filter part 11, a pair of trimming electrodes 12*a* and 12*b* is formed on the upper surface of the uppermost substrate 12, each having its end portions extended to middle sections of the mutually opposite longer side edges of the rectangular substrate 12 and connected to the external electrodes 22 and 26 or 23 and 27. Although the substrate 12, thus formed, is for the purpose of adjusting the resonance frequency of the filter part 11, it is not an indispensable component and may be omitted.

The second substrate 13 from the top of the filter part 11 has a pair of shield electrodes 13*a* and 13*b* formed on its upper surface. One end portion of each of these shield electrodes 13*a* and 13*b* is extended to one of the longer side edges of the substrate 13 near its end section and is connected to the external electrode 21 or 24. The shield electrode 13*a* and the external electrode 21 are adapted to serve as the input section of the filter part 11.

The third substrate 14 of the filter part 11 has a pair of capacitor electrodes 14*a* and 14*b* formed on its upper surface. Both end portions of each capacitor electrode 14*a* or 14*b* are extended to middle sections of the mutually opposite longer side edges of the substrate 14 and connected respectively to the external electrodes 22 and 26 or 23 and 27.

The bottom substrate 15 of the filter part 11 has a pair of coil (inductor) electrodes 15*a* and 15*b* formed on its upper surface One end portion of each of these coil electrodes 15*a* and 15*b* is extended to one of the longer side edges of the substrate 15 near its end section and is connected to the external electrode 21 or 24. The other end portions of these coil electrodes 15*a* and 15*b* are extended to a middle section of the opposite longer side edge of the substrate 15 and are connected to the external electrodes 26 and 27. The external electrode 24 is adapted to serve as the output section of the filter part 11.

Figure 2:
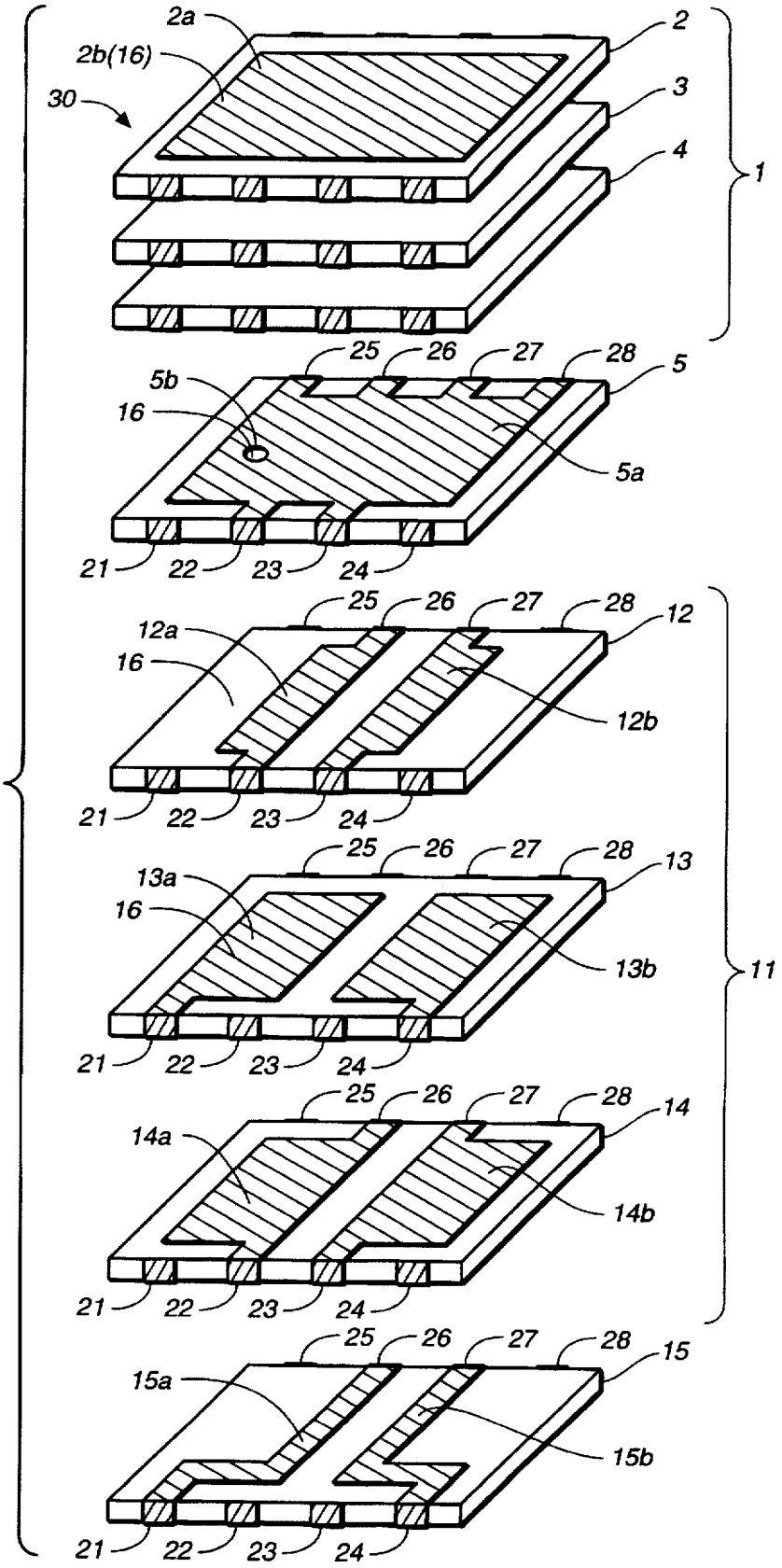
FIG. 2 is an exploded diagram of the antenna device of FIG. 1.

The antenna part 1 is set on top of the filter part 11, and a throughhole 16 containing an electrode therein is formed from a feed point 2*b* on. the radiating electrode 2*a* of the antenna part 1 through the dielectric substrates 2, 3, 4, 5 and 12 to the shield electrode 13*a* of the filter part 11, such that the feed point 2*b* and the input section of the filter part 11 are electrically connected. In FIG. 2, symbol 5*b* indicates a portion of the substrate 5 which has been removed in order to insulate the electrode inside the throughhole 16 from the grounding electrode 5*a*.

The antenna device 30, thus formed, can be surface-mounted to a printed circuit board (not shown) with electrode patterns formed on its surface. The lower surface of the bottom substrate 15 of the filter part 11 is contacted with the surface, and the external electrodes 21–28 are soldered to the electrode patterns.

Figure 3:
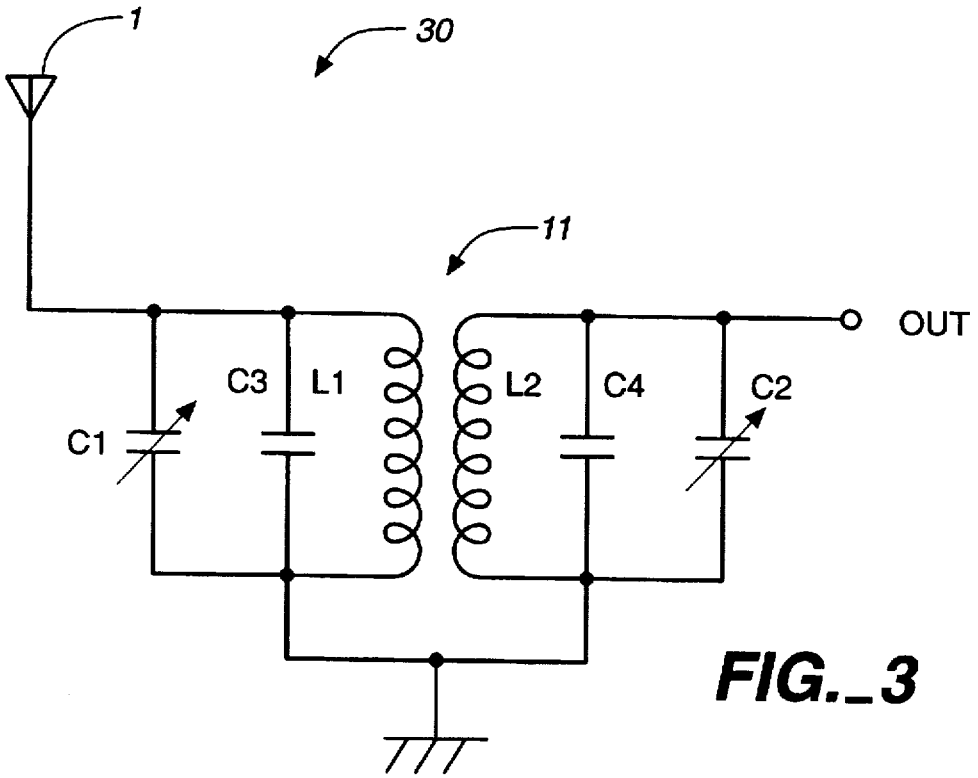
FIG. 3 is an equivalent circuit diagram of the antenna device of FIGS. 1 and 2.

FIG. 3 is an equivalent circuit diagram of the antenna device 30. Capacitors $C_1$ and $C_2$ are formed between the shield electrodes 13*a* and 13*b* on the second dielectric substrate 13 and the trimming electrodes 12*a* and 12*b* on the uppermost dielectric substrate 12 of the filter part 11. The resonant frequency of the filter part 11 can be adjusted by varying the areas of the trimming electrodes 12*a* and 12*b*. Capacitors $C_3$ and $C_4$ are formed between the shield electrodes 13*a* and 13*b* on the second dielectric substrate 13 and the capacitor electrodes 14*a* and 14*b* on the third substrate 14 of the filter part 11. Coils (inductors) L, and $L_2$ are formed by the coil electrodes 15*a* and 15*b* on the bottom substrate 15 of the filter part 11.

Next, another antenna device according to a second embodiment of this invention will be described. Since its filter part is identical to that for the antenna device 30 described above with reference to FIG. 2, only its antenna part is shown at 48 in FIG. 4.

Figure 4:
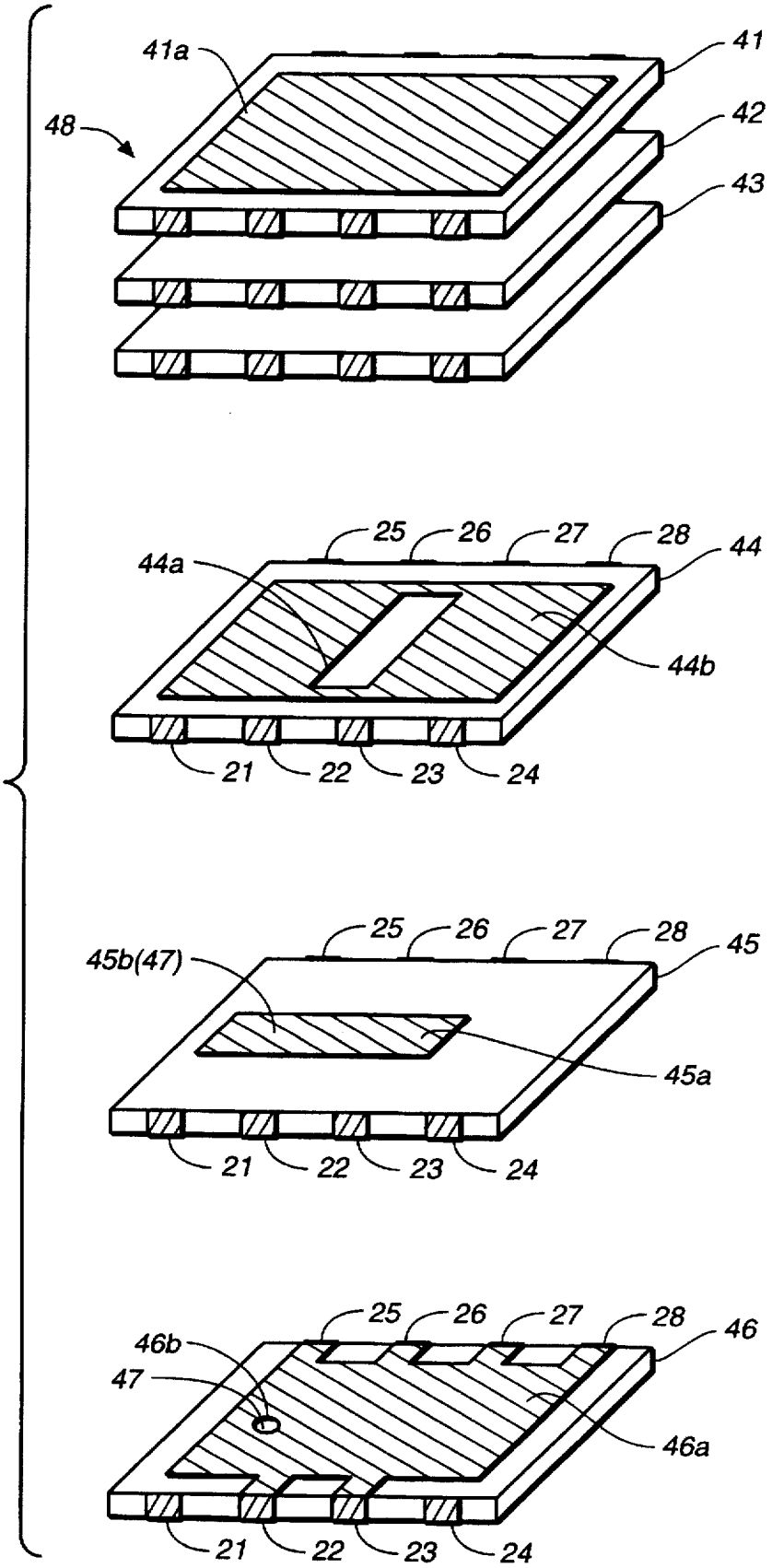
FIG. 4 is an exploded diagram of a portion of another antenna device according to a second embodiment of this invention.
Figure 5:
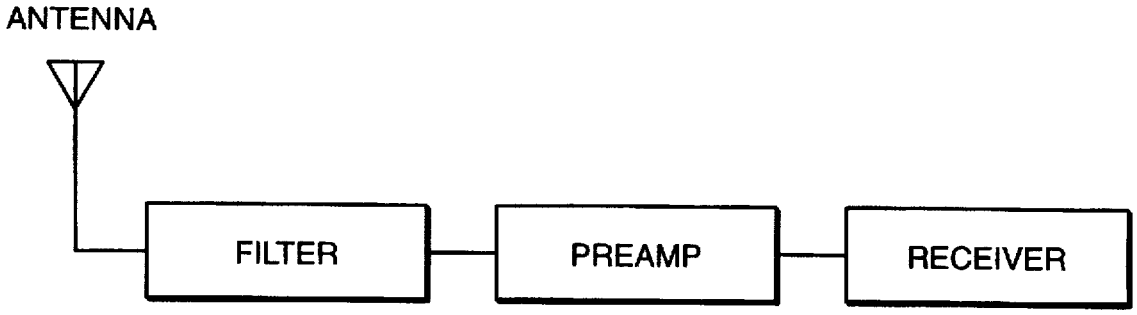
FIG. 5 (PRIOR ART)
FIG. 5 is a block diagram of a prior art receiver system.
Figure 6:
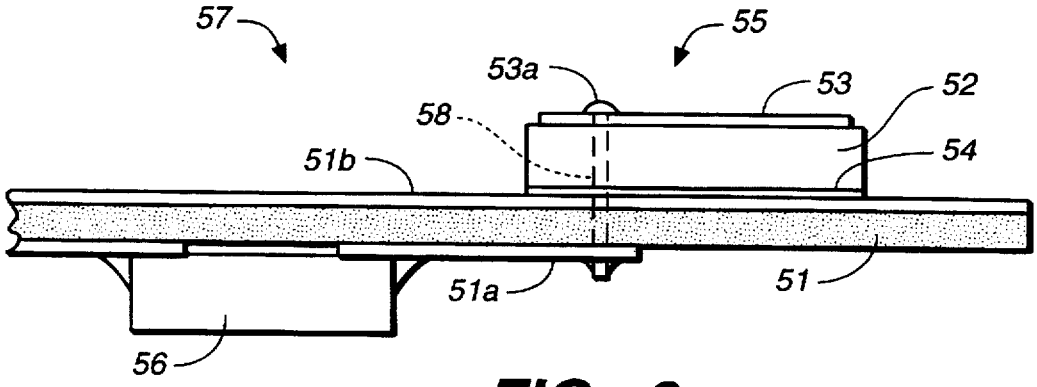
FIG. 6 (PRIOR ART)
FIG. 6 is a sectional side view of a prior art antenna device.

In FIG. 4, numeral 41 indicates a top rectangular dielectric substrate with a radiating electrode 41*a* formed on its upper surface, and there are two dielectric substrates 42 and 43 therebelow, serving as dummy layers. Below the dummy layers is a fourth rectangular dielectric substrate 44 having a slot electrode 44*b* formed on its upper surface with a slot 44*a* nearly at the center of the electrode 44*b* and extending in the direction parallel to the shorter side edges of the rectangle.

Below the fourth substrate 44 is a fifth dielectric substrate 45 having a strip line 45*a* formed on its upper surface, extending perpendicularly to the direction of extension of the slot 44*b*. Below the lower surface of the fifth substrate 45 is a sixth dielectric substrate 46 having a grounding electrode 46*a* formed on its upper surface with end portions connected to external electrodes 22, 23 and 25–28 (also shown in FIG. 1). A throughhole 47 containing an electrode inside is provided to connect a feed point 45*b* on the strip line 45*a* through the dielectric substrates 45 and 46 to the lower surface of the sixth substrate 46. Symbol 46*b* indicates a portion of the substrate 46 which has been removed in order to insulate the electrode inside the throughhole 47 from the grounding electrode 46*a*.

The antenna part 48 thus structured is adapted to be set above a filter part such as illustrated in FIG. 2. The throughhole 47 through the antenna part 48 is connected to the throughhole 16 through the uppermost substrate 12 of the filter part 11 to form the antenna device according to the second embodiment of the invention, which functions similarly to the device according to the first embodiment.

As explained above, antenna devices according to this invention are compact because the antenna and filter parts are formed as a single combined unit inside layers of dielectric substrates. The production process is simplified, and since the mounting to a printed circuit board can be effected by a single operation, the costs of parts and mounting can be both reduced. Moreover, since the antenna and filter parts are connected internally through a shortest path inside a throughhole, there is no instability in the impedance matching between the antenna and filter parts. This has the favorable result of lowering the reflection loss and enables transmission with reduced signal loss.

What is claimed is:

1. An antenna device comprising:

a layered structure of dielectric substrates;

an antenna part formed as a portion of said layered structure, said antenna part comprising a radiating electrode formed on a surface of said layered structure and a grounding electrode formed inside said layered structure;

a filter part having an input section and an output section, said filter part being formed inside said layered structure and below said antenna part, and including a dielectric substrate having a pair of shield electrodes on one surface thereof, another dielectric substrate having a pair of capacitor electrodes on one surface thereof, and still another dielectric substrate having a pair of coil electrodes on one surface thereof, a feed point on said radiating electrode being electrically connected with said input section of said filter part through a throughhole formed through said layered structure; and external electrodes formed on side surfaces of said layered structure, said external electrodes connecting said grounding electrode and said output section of said filter part.

2. The antenna device of claim 1 wherein one of said shield electrodes and one of said external electrodes serve as said input section.

3. The antenna device of claim 2 wherein another one of said external electrodes serves as said output section.

4. The antenna device of claim 1 further comprising an additional dielectric substrate having a pair of trimming electrodes on one surface thereof for adjusting the resonance frequency of said filter part.

5. The antenna device of claim 1 further comprising:

a slot electrode having a slot formed therethrough; and a strip line elongated perpendicularly to said slot, said slot trode and said strip line being between said radiating electrode and said grounding electrode.

6. The antenna device of claim 1 wherein said shield electrodes and said capacitor electrodes provide capacitance therebetween.

7. The antenna device of claim 1 wherein said coil electrodes provide inductance.

8. The antenna device of claim 5 wherein said shield electrodes said capacitor electrodes provide capacitance therebetween.

9. The antenna device of claim 5 wherein said coil electrodes provide inductance.

* * * * *